US007043881B2

(12) United States Patent
Krause, Sr. et al.

(10) Patent No.: US 7,043,881 B2
(45) Date of Patent: May 16, 2006

(54) INSULATED GLASS ASSEMBLY WITH AN INTERNAL LIGHTING SYSTEM

(75) Inventors: Richard J. Krause, Sr., Elkhart, IN (US); Richard J. Krause, Jr., Niles, MI (US)

(73) Assignee: Tem-Pace, Inc., Niles, MI (US)

( * ) Notice: Subject to any disclaimer, the term of this patent is extended or adjusted under 35 U.S.C. 154(b) by 18 days.

(21) Appl. No.: 10/173,207

(22) Filed: Jun. 14, 2002

(65) Prior Publication Data

US 2003/0230045 A1 Dec. 18, 2003

(51) Int. Cl.
*F21S 8/00* (2006.01)
*F21V 1/00* (2006.01)

(52) U.S. Cl. ..... 52/171.3; 52/171.2; 52/786.13; 52/788.1; 52/204.593; 362/145; 362/235; 428/34; 40/578

(58) Field of Classification Search ..... 52/786.13, 52/786.11, 171.1, 171.2, 171.3, 783.12, 783.19, 52/784.12, 788.1, 792.11, 204.593, 784.16; 362/145, 31, 151, 235; 40/578, 572, 564; 156/109, 292; 428/34; 277/318, 319, 320, 277/321

See application file for complete search history.

(56) References Cited

U.S. PATENT DOCUMENTS

| | | | | | |
|---|---|---|---|---|---|
| 905,468 | A | * | 12/1908 | Shearer | 40/578 |
| 1,106,135 | A | * | 8/1914 | Dawes | 40/578 |
| 1,796,694 | A | * | 3/1931 | Silva | 40/578 |
| 2,348,307 | A | * | 5/1944 | Richardson | 52/788.1 |
| 2,587,063 | A | * | 2/1952 | Petsch | 52/788.1 |
| 3,105,274 | A | * | 10/1963 | Armstrong | 52/204.7 |
| 3,760,157 | A | * | 9/1973 | Newman et al. | 219/522 |
| 3,919,023 | A | * | 11/1975 | Bowser et al. | 156/107 |
| 4,084,720 | A | * | 4/1978 | Thurston | 220/76 |
| 4,109,431 | A | * | 8/1978 | Mazzoni et al. | 52/172 |
| 4,128,448 | A | * | 12/1978 | Bitterice et al. | 156/166 |
| 4,481,887 | A | * | 11/1984 | Urbano | 109/3 |
| 4,812,954 | A | * | 3/1989 | Marton | 362/134 |
| 5,021,074 | A | * | 6/1991 | Kovacik et al. | 65/40 |
| 5,268,049 | A | * | 12/1993 | Marriott et al. | 156/99 |
| 5,313,761 | A | * | 5/1994 | Leopold | 52/788 |

(Continued)

FOREIGN PATENT DOCUMENTS

| | | | | |
|---|---|---|---|---|
| GB | 1189518 | * | 4/1970 | 52/204.1 |

(Continued)

*Primary Examiner*—Lanna Mai
*Assistant Examiner*—Phi Dieu Tran A
(74) *Attorney, Agent, or Firm*—R. Tracy Crump

(57) ABSTRACT

An insulated glass (IG) assembly for windows which includes an internal lighting system is disclosed. The IG assembly includes two or more panes of glass, a spacer and a strip of light emitting diodes (LEDs). The spacer separates glass panes and provides the hermetic seal for the IG assembly. The spacer extends around the periphery of the glass panes with a portion of its ends overlapping to form a sealed corner joint. The LED light strip includes a plurality of LED lamps connected in series by thin electrical contact wires fixed in a flexible nonconductive substrate. The LED strip is fixed to the spacer and extends around the periphery of the insulated glass unit. The lead wires from the LED light strip pass through the corner joint between the overlapped ends of the spacer. The LED light systems provide dependable illumination but emit relatively little thermal energy. Consequently, the LED light system maintains the thermal insulating properties of an insulated glass unit. The IG assembly can be incorporated into top and side lite windows or incorporated directly into doors themselves.

4 Claims, 5 Drawing Sheets

U.S. PATENT DOCUMENTS 5,329,437 A * 7/1994 Briggs ..... 362/393
5,426,572 A * 6/1995 Weinstock et al. ..... 362/133
5,426,573 A * 6/1995 Jenkins ..... 362/154
5,458,716 A * 10/1995 Alfaro et al. ..... 156/245
5,475,241 A * 12/1995 Harrah et al. ..... 257/99
5,637,363 A * 6/1997 Leray et al. ..... 428/34
5,813,454 A * 9/1998 Potter ..... 165/276
6,186,644 B1 * 2/2001 Mosseau ..... 362/249
6,441,943 B1 * 8/2002 Roberts et al. ..... 359/267
6,601,972 B1 * 8/2003 Sei et al. ..... 362/236
6,623,151 B1 * 9/2003 Pederson ..... 362/542
6,674,097 B1 * 1/2004 Komoto et al. ..... 257/98

FOREIGN PATENT DOCUMENTS

GB 2183387 * 6/1987 ..... 362/31

* cited by examiner

INSULATED GLASS ASSEMBLY WITH AN INTERNAL LIGHTING SYSTEM

This invention relates to insulated glass panes used for windows, and describes an internally illuminated insulated glass pane.

BACKGROUND OF INVENTION

Insulated glass (IG) assemblies are used in most window and door applications. IG assemblies are constructed of two or more sheets (panes) of glass, and a spacer including a stabilizer and sealant strip placed between the sheets and extending around the entire perimeter of the panes. The separated glass panes create an envelop of dead air which when used in a window or door, greatly reduces the passage of heat through the pane.

It has long been desirable to incorporate lighting systems into IG assemblies. Internally illuminating IG assemblies could replace exterior light systems in front of windows and doors with more aesthetically pleasing and unobtrusive internal lighting systems. Internally illuminated IG assemblies provide illumination on both sides of a window or doorway, which adds an important safety feature to any window or doorway. Since the light is enclosed within the window's IG assembly, the light cannot be tampered with without detection. Internally illuminated IG assemblies provide an improved aesthetic appearance by accenting various sculptured and stained glass panes.

Attempts, however, to incorporate internal lighting systems into IG assemblies have been unsuccessful and impractical. Heretofore, attempts at internally illuminating insulated glass units involved inserting conventional incandescent lights into the sealed air space between glass panes. Conventional incandescent lights are ill suited for use in IG assemblies for a variety of reasons. One obvious problem is the relatively short life span of even the best incandescent lamp. Once a lamp filament burns out, the entire glass unit must be replaced, which makes such IG assemblies cost prohibitive. A more subtle, but equally significant problem is the thermal energy emitted from the conventional incandescent lights. Incandescent lights emit visible light as a result of heating a filament with an electric current. The electrical current passing through the filament generates significant thermal energy. This thermal energy can cause significant contraction and expansion of the spacer bar, which can result in air leakage and a less efficient insulated glass pane. The thermal energy can also break down the sealant and desiccant materials of the spacers. Reducing the current flow through the filament only slightly reduces the thermal energy problem, but also proportionately reduces the illumination of the light. Fluorescent and neon lights produce relatively low thermal energy, but are impractical for use in insulated glass due to the cost and physical nature of incorporating fluorescent or neon tubes as spacer bars of insulated glass panes. Consequently, a low thermal energy emitting light source, and an effective mechanism for heretically sealing the light source within the air space is needed to create a practical internally illuminated glass pane.

SUMMARY OF INVENTION

This invention provides an internally illuminated insulated glass assembly for use in window or door applications. The IG assembly of this invention uses an internal lighting system of light emitting diodes (LEDs). The LED light systems provide dependable illumination but emit relatively little thermal energy. Consequently, the LED light system maintains the thermal insulating properties of an insulated glass unit. The IG assembly can be incorporated into top and side lite windows or incorporated directly into doors themselves. The internally illuminated IG assembly provides an aesthetically attractive appearance for the window or doorway. In addition, the IG assembly provides improved safety features by illuminating areas on either side of the window.

The IG assembly of this invention includes two or more sheets or panes of glass, a spacer and a strip of light emitting diodes (LEDs). The spacer separates the overlying parallel glass panes and provides the hermetic seal for the IG assembly. The spacer extends around the periphery of the IG assembly with a portion of its ends overlapping to form a single sealed corner joint. The LED light strip includes a plurality of LED lamps connected in series by thin electrical contact wires fixed in a flexible nonconductive substrate. LEDs are rectifying semiconductors that convert electric energy into electromagnetic radiation. The LED light strip is mounted to the spacer and extends around the periphery of the insulated glass unit. The lead wires from the LED light strip pass through the corner joint between the overlapping ends of the sealant/spacer. The overlap of the spacer ends provides a hermetic seal around the lead wires. The LED light strip can be connected to any electrical power source, such as a DC battery or AC line power with the use of a voltage regulator.

The use of an LED light system enables the insulated glass units to be internally illuminated. Unlike incandescent lamps, LED lamps are ideally suited for providing the internal lighting system for an insulated glass unit. LED lamps are small and fit easily into the small air space between the glass panes. LED lamps generate very little thermal energy, which eliminates thermal expansion problems with the spacer thereby maintaining the hermetic seal of the IG assembly. The LED lamp strips are light weight and flexible so as to conform to the bends and curves assumed by the spacer in various pane shapes and configurations. The LED lamps provide low energy consumption.

Accordingly, an advantage of this invention is to provide an internal lighting system for an insulated glass assembly.

Another advantage of this invention is that the IG assembly uses LED lighting systems, which have lower power consumption and lower thermal energy emissions.

Another advantage of this invention is that the IGU includes an internal lighting system without effecting thermal insulation.

Another advantage of this invention is that the internal lighting system of the IGU allows for a improved safety feature for various window and door applications.

Other advantages will become apparent upon a reading of the following description.

BRIEF DESCRIPTION OF THE DRAWINGS

The preferred embodiments of the invention have been depicted for illustrative purposes only wherein.

DESCRIPTION OF THE PREFERRED EMBODIMENT

The preferred embodiments herein described are not intended to be exhaustive or to limit the invention to the precise form disclosed. They are chosen and described to explain the invention so that others skilled in the art might utilize its teachings.

Figure 1:
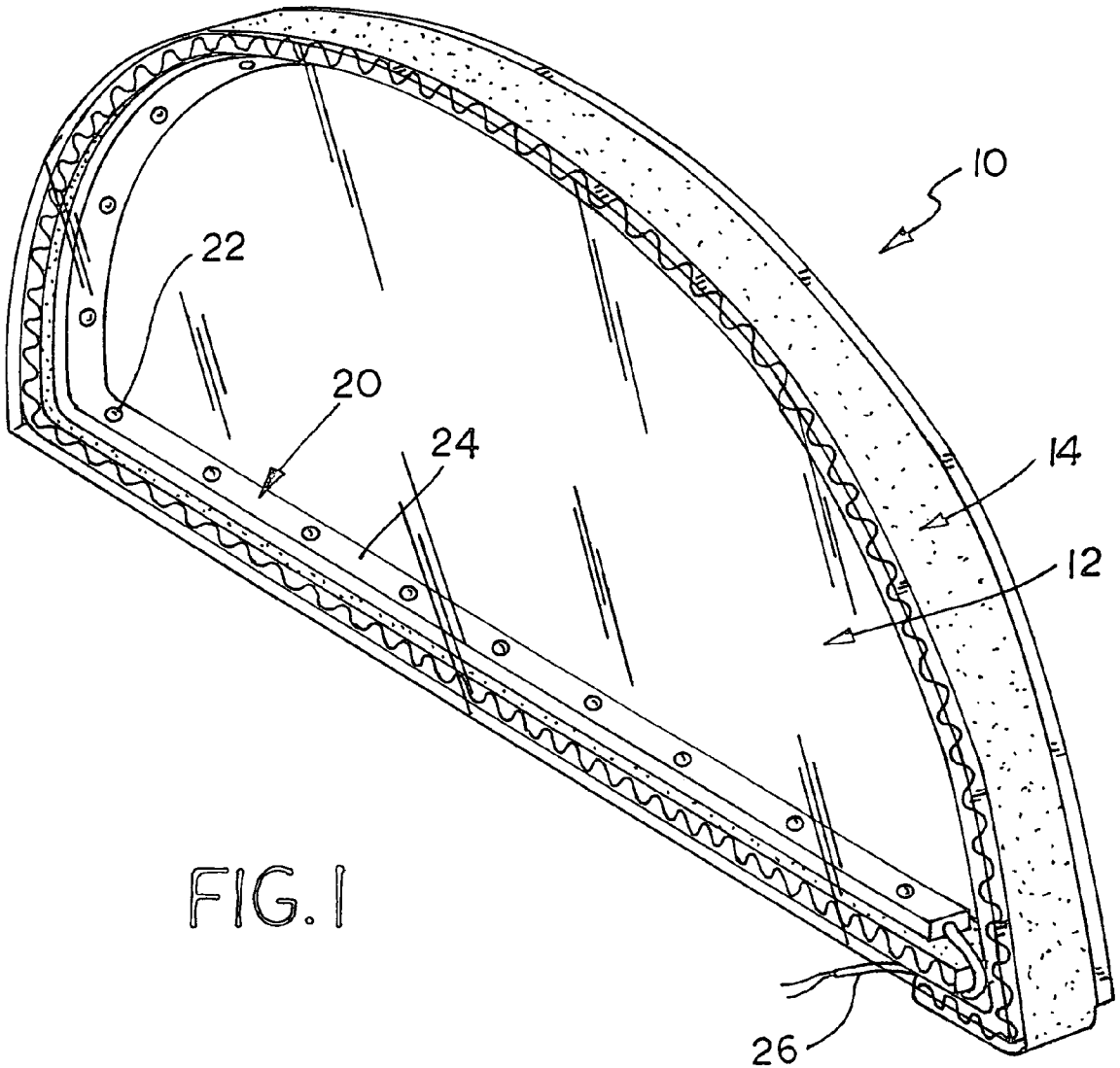
FIG. 1 is a perspective view of one embodiment of the insulated glass (IG) assembly of this invention illustrated as a top lite window for a doorway.
Figure 2:
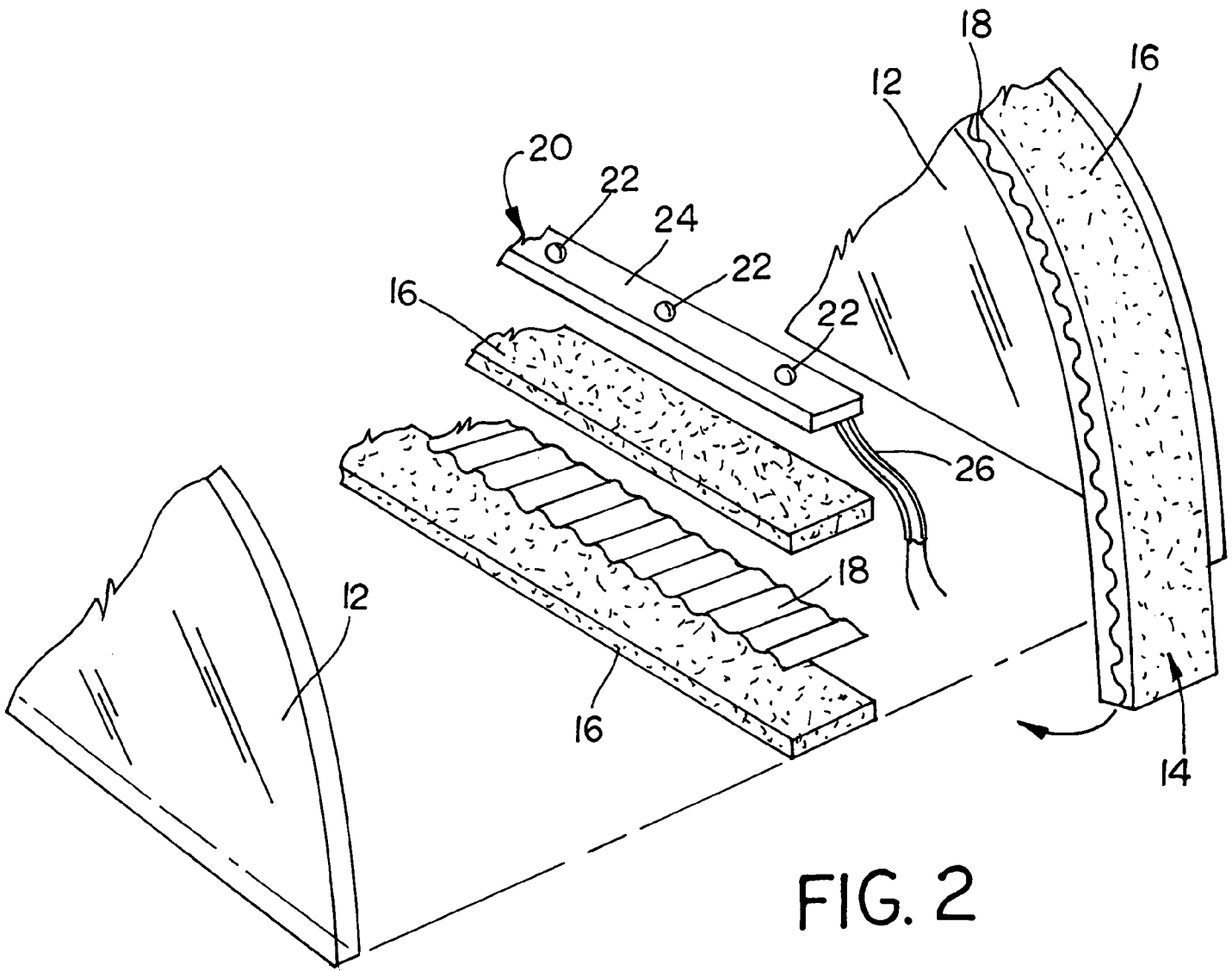
FIG. 2 is an exploded view of the IG assembly of FIG. 1.
Figure 3:
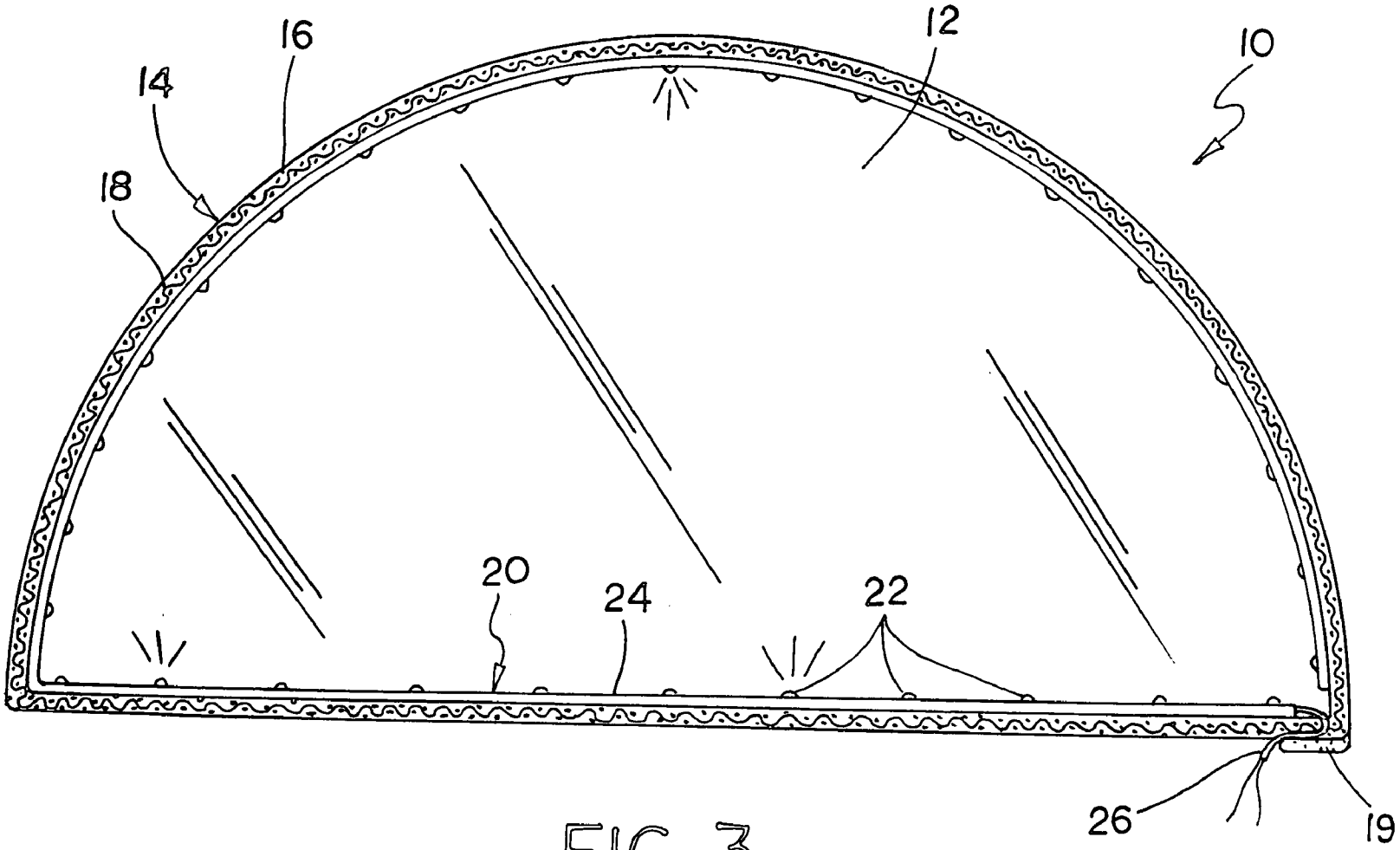
FIG. 3 is a side sectional view of the IG assembly of FIG. 1.
Figure 5:
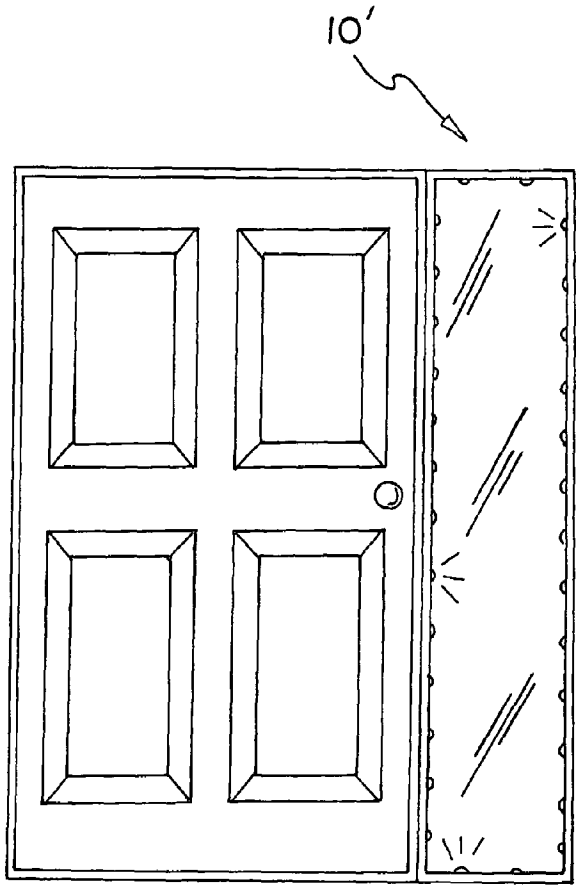
FIG. 5 is a side plan view of an doorway and a side lite window using another embodiment (rectangular) of the IG assembly of this invention.
Figure 4:
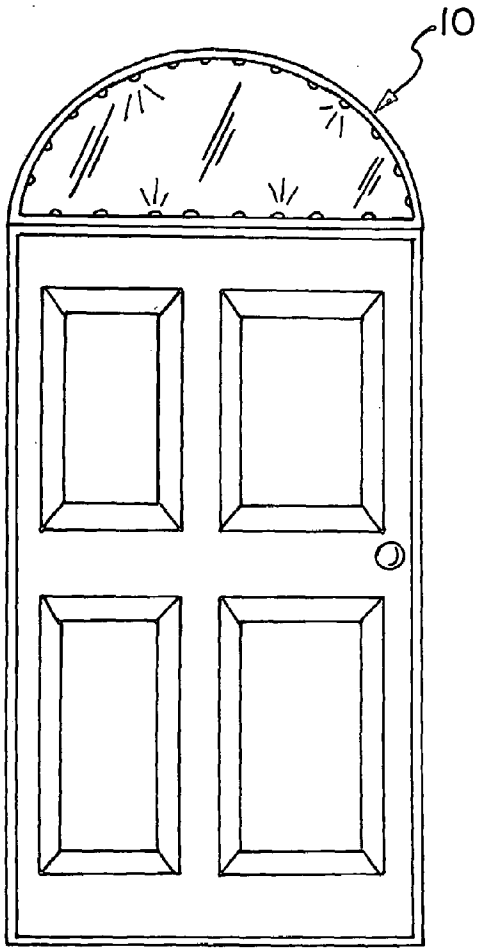
FIG. 4 is a side plan view of an doorway and a top lite window using the IG assembly of FIG. 1.

FIGS. 1–3 illustrate the basic design and construction of the insulated glass assembly of this invention, which is designated as reference numeral 10. IG assembly 10 of FIGS. 1–3 is illustrated for use as a top lite window, but may be configured for use in any window or door application. FIGS. 4 and 5 illustrate other such window applications. FIG. 4 illustrates IG assembly 10 used in a top lite window for a doorway. FIG. 5 illustrates a second embodiment of IG assembly (a rectangular unit designated as reference numeral 10') used in a side lite window for a doorway. Both embodiments have identical construction and differ only in the configuration of the glass panes. The embodiments illustrated and described herein are intended to demonstrate the application of the IG assembly of this invention and not to limit the scope of this invention.

As shown in FIGS. 1–3, IG assembly 10 includes two sheets or panes of glass 12, a spacer 14 and the LED light strip 20. Glass pane 12 can take any shape, size or configuration as desired for any particular window or door application. The glass pane may be transparent, translucent or of sculptured glass as desired to present decorative appearance. Spacer 14 separates glass panes 12 and provides the hermetic seal for the insulated glass unit. It should be noted that IG assembly 20 may use three or more glass panes 12 with multiple spacers within the scope of this invention.

Preferably, spacer 14 is of the type described in U.S. Pat. No. 4,431,691 and manufactured by Tru-Seal Technologies, Inc. of Beachwood, Ohio under the trademark SWIGGLE (United States Trademark Registration No. 1,580,086). Although, this type of spacer is desirable, any conventional spacer designed for use in insulated glass may be employed without deviating from the teaching of this invention. Spacer 14 includes an elongated ribbon of deformable sealant 16 enveloping and having embedded therein a stabilizer 18. The stabilizer 18 is an undulating band of rigid material, such as metal or plastic, but preferably aluminum. Stabilizer 18 provides the structural support to maintain the airspace between the two glass panes. Sealant 16 is constructed of any suitable material to provide a hermetic seal with the glass panes 12, including such thermoplastic and thermosetting materials as polysulfide polymers, urethane polymers, acrylic polymers and styrene-butadiene polymers. Sealant material also may include a desiccant material, which is used to absorb moisture and incorporate into the sealant material. Spacer 14 can be bent around the corners of the glass panes, which is particularly desirable where the spacer is employed to act as a thermal insulation barrier. As shown, spacer 14 extends around the periphery of glass pane 12 with a portion of its ends overlapping to form a single joint 19. The overlapping of the spacer 14 ends hermetically seals the airspace within insulated glass unit 10.

As shown, LED strip 20 is fixed to the inner face of spacer 14 and extends around the periphery of the insulated glass unit 10. LED light strip 20 includes a plurality of LEDs (light emitting diodes) 22 connected in series by thin electrical contact wires 26 fixed in a flexible nonconductive substrate 24. LEDs are rectifying semiconductors that convert electric energy into electromagnetic radiation. Ideally, LED 22 is a gallium arsenide LED, which produces a high efficiency light comparable to small incandescent lamps. LED Strip 20 is secured to spacer 14 so that the LED lamps face inward. The strip substrate is thin and pliable so as to bend and conform to the lie of spacer 14 within the insulated glass unit 10. Although, the adhesive properties of sealant material is generally sufficient to secure LED strip 20 to the spacer 14, any suitable means may be used to secure the LED strip to the sealant/spacer. As shown, lead wires 26 extend from strip substrate 24 and pass through joint 19 between the overlapping ends of spacer 14. The overlap of the spacer ends provides a hermetic seal around the lead wires 26. LED light strip 20 is connected to any available electrical power supply. LED light strip 20 can be powered directly by a DC power source, such as a battery (not shown), or by an AC power line with the use of a converter and/or voltage regulator.

Figure 6:
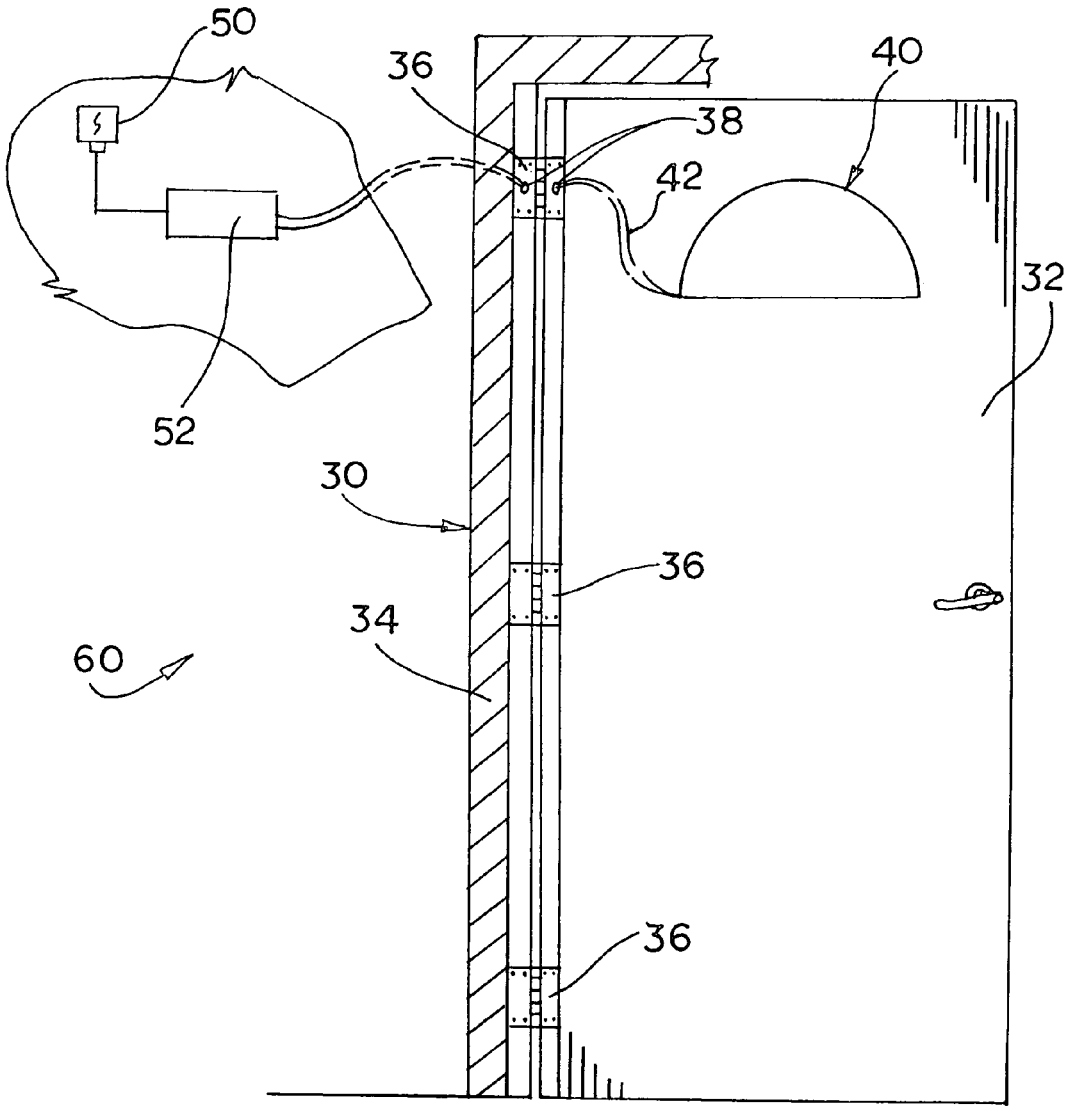
FIG. 6 is a side perspective view of an integrated doorway/IG lighting system that incorporates the IG assembly of this invention directly into a conventional doorway showing a simplified electrical schematic in a cut-away section of the wall.

FIG. 6 illustrates an integrated doorway/IG lighting system 60 that incorporates the IG assembly 40 of this invention directly into the doorway 30. As shown, doorway 30 includes a door 32 pivotally connected to a door frame 34 by leaf hinges 36. IG assembly 40 is fitted within door 32 with wire leads 42 running through the door body. Wire leads 42 are connected in series with an AC line power 50 through a voltage convertor/regulator 52 through contacts 38 in hinges 36. Contacts 38 provide an electrical contact switch, which complete the circuit between AC power source 50 and IG assembly 40, when the door is closed. As shown, IG assembly 40 is powered by conventional AC line power, which is readily available in commercial and residential buildings, but alternatively IG assembly 40 could be powered by a DC battery incorporated as part of doorway/lighting system 60.

ADVANTAGES

One skilled in the art will note several advantages of the insulated glass unit of this invention. The IG assembly of this invention provides a practical self contained internal lighting system, which can be used in any window or door application, while maintaining the thermal insulating properties of an insulated glass unit. The internal lighting system of the IG assembly provides an aesthetically attractive appearance for the window or doorway. In addition, the IG assembly provides improved safety features by illuminating areas on either side of the window.

The use of LED lamps enables the insulated glass units to be internally illuminated. Unlike incandescent lamps, LED lamps are ideally suited for providing the internal lighting system for an insulated glass unit. LED lamps are small and fit easily into the small air space between the glass panes. LED lamps generate very little thermal energy, and as a result the spacer is not subject to the thermal expansion problems which can compromise the hermetic seal of the IG assembly. The LED lamp strips are light weight and flexible so as to conform to the bends and curves assumed by the sealant/spacer in various pane shapes and configurations. The LED lamps provide low energy consumption.

It is understood that the above description does not limit the invention to the details given, but may be modified within the scope of the following claims.

We claim:

1. An insulated glass assembly for use in a window comprising:

first and second glass panes having facing generally parallel surfaces spaced a finite distance from each other, spacer means adhered to and extending around the periphery of the first and second glass panes for effecting a hermetically sealed air space between the first and second glass panes, and lighting means connectable to an electrical power source and disposed within the sealed air space for radiating light through at least one of the first and second glass panes with low thermal energy emission so as to prevent thermal expansion of the spacer means thereby maintaining the integrity of the hermetically sealed air space when connected to an electrical power source, the spacer means includes an elongated ribbon of sealant material having a first sealant end and a second sealant end, the ribbon of sealant adhering to the facing surface of the first and second glass panes with the first sealant end overlapping the second sealant end in adhering contact so as to hermetically seal the sealed air space between the first and second glass panes, the lighting means includes at least one light emitting diode lamp and wires for connecting the light emitting diode lamp to the electrical power source, the wires include a first end connected to the light emitting diode lamp within the sealed air space and a second end extending through the spacer means and interposed in adhesive engagement between the first end of the spacer means and second end of the spacer means.

2. The insulated glass assembly of claim 1 wherein the spacer means includes an elongated spacer strip enveloped and embedded in the ribbon of sealant, the spacer strip being in approximate contact with the facing surface of the first and second glass panes to separate the first and second glass panes at a finite distance.

3. A combination comprising a doorway and an insulated glass assembly having an internal lighting system, the doorway includes a frame defining an entryway, a door having an opening therein, a hinge pivotally connecting the door to the frame to allow the door to move between an open position and a closed position, the hinge includes means for electrically connecting the insulated glass assembly to an electrical power supply, the insulated glass assembly is disposed within the opening in the door and includes first and second glass panes having facing generally parallel surfaces spaced a finite distance from each other, spacer means adhered to and extending around the periphery of the first and second glass panes for effecting a hermetically sealed air space between the first and second glass panes, and lighting means connectable to an electrical power source and disposed within the sealed air space for radiating light through at least one of the first and second glass panes with low thermal energy emission so as to prevent thermal expansion of the spacer means thereby maintaining the integrity of the hermetically sealed air space when connected to an electrical power source, the spacer means includes an elongated ribbon of sealant material having a first sealant end and a second sealant end, the ribbon of sealant adhering to the facing surface of the first and second glass panes with the first sealant end overlapping the second sealant end in adhering contact so as to hermetically seal the sealed air space between the first and second glass panes, the lighting means includes at least one light emitting diode lamp and wires for connecting the light emitting diode lamp to the electrical power source, the wires include a first end connected to the light emitting diode lamp within the sealed air space and a second end extending through the spacer means and interposed in adhesive engagement between the first end of the spacer means and second end of the spacer means.

4. The combination of claim 3 wherein the spacer means includes an elongated spacer strip enveloped and embedded in the ribbon of sealant, the spacer strip being in approximate contact with the facing surface of the first and second glass panes to separate the first and second glass panes at a finite distance.

* * * * *